US009879693B2

(12) United States Patent
Boening et al.

(10) Patent No.: US 9,879,693 B2
(45) Date of Patent: Jan. 30, 2018

(54) EXHAUST GAS TURBOCHARGER SHAFT HAVING AN IMPELLER

(71) Applicant: CONTINENTAL AUTOMOTIVE GMBH, Hannover (DE)

(72) Inventors: Ralf Boening, Reiffelbach (DE); Philipp Mehne, Gruenstadt (DE)

(73) Assignee: Continental Automotive GmbH, Hannover (DE)

( * ) Notice: Subject to any disclaimer, the term of this patent is extended or adjusted under 35 U.S.C. 154(b) by 355 days.

(21) Appl. No.: 14/435,759

(22) PCT Filed: Oct. 10, 2013

(86) PCT No.: PCT/EP2013/071115
§ 371 (c)(1),
(2) Date: Apr. 15, 2015

(87) PCT Pub. No.: WO2014/060274
PCT Pub. Date: Apr. 24, 2014

(65) Prior Publication Data

US 2015/0267712 A1 Sep. 24, 2015

(30) Foreign Application Priority Data

Oct. 15, 2012 (DE) ..... 10 2012 218 692

(51) Int. Cl.
*F04D 29/26* (2006.01)
*F04D 17/00* (2006.01)
*F04D 29/40* (2006.01)

(52) U.S. Cl.
CPC ..... *F04D 29/266* (2013.01); *F04D 17/00* (2013.01); *F04D 29/403* (2013.01); *F05D 2220/40* (2013.01)

(58) Field of Classification Search
CPC ..... F04D 29/266; F04D 29/403; F04D 17/00; F04D 29/284; F04D 29/263;
(Continued)

(56) References Cited

U.S. PATENT DOCUMENTS 1,665,458 A 4/1928 Hollander
2,443,688 A 6/1948 McFarland
(Continued)

FOREIGN PATENT DOCUMENTS

CN 1510259 A 7/2004
DE 60311725 T2 11/2007
(Continued)

OTHER PUBLICATIONS

Henkel Corporation; Loctite Technical Data Sheet; May 22, 2010.*

*Primary Examiner* — Gregory Anderson
*Assistant Examiner* — Eldon Brockman
(74) *Attorney, Agent, or Firm* — Laurence A. Greenberg; Werner H. Stemer; Ralph E. Locher

(57) ABSTRACT

An exhaust gas turbocharger shaft has an impeller connected to the exhaust gas turbocharger shaft in a form-locking manner and is connected to a shaft nut provided on an outer shell surface of the exhaust gas turbocharger shaft. The shaft nut is inserted into a central bore of the impeller in such a way that the impeller forms a form-locking connection with the shaft nut in the radial direction and the circumferential direction.

9 Claims, 3 Drawing Sheets

(58) Field of Classification Search
CPC ..... F04D 29/662; F04D 29/044; F04D 29/20; F04D 29/22; F04D 29/2222; F01D 5/025
See application file for complete search history.

(56) References Cited

U.S. PATENT DOCUMENTS 2,799,445 A * 7/1957 Hull ..... F01D 5/025 384/416
2,967,486 A 1/1961 Spence
4,125,344 A * 11/1978 Tiefenbacher ..... F01D 5/045 416/183
4,257,744 A * 3/1981 Watson ..... F04D 29/266 403/282
4,915,589 A * 4/1990 Gessler ..... F01D 5/025 415/217.1
4,944,660 A 7/1990 Joco
5,022,823 A 6/1991 Edelmayer
5,163,816 A * 11/1992 Goetzke ..... F01D 5/025 403/2
5,205,716 A 4/1993 Georges et al.
5,882,178 A * 3/1999 Hudson ..... F04D 29/266 403/334
5,961,246 A * 10/1999 Mitsubori ..... F16D 1/06 403/359.4
5,961,247 A * 10/1999 Gold ..... F01D 5/025 403/369
6,164,931 A * 12/2000 Norton ..... F04D 29/266 29/889.2
6,481,970 B2 * 11/2002 Mukherjee ..... F04D 25/04 416/204 A
7,008,191 B2 * 3/2006 Billington ..... F04D 29/266 416/204 A
7,470,115 B2 * 12/2008 Meacham ..... F01D 5/025 416/204 A
2002/0001522 A1 * 1/2002 Mukherjee ..... F04D 25/04 416/185
2004/0131469 A1 * 7/2004 Billington ..... F04D 29/266 416/204 R
2006/0013693 A1 * 1/2006 Meacham ..... F01D 5/025 416/244 R

FOREIGN PATENT DOCUMENTS

DE 102008056058 A1 2/2010
DE 102010010136 A1 9/2011
WO 8902537 A1 3/1989

* cited by examiner

EXHAUST GAS TURBOCHARGER SHAFT HAVING AN IMPELLER

BACKGROUND OF THE INVENTION

Field of the Invention

The invention relates to an exhaust-gas turbocharger shaft which has an impeller connected thereto.

The impellers of an exhaust-gas turbocharger must be connected to the exhaust-gas turbocharger shaft such that, during the operation of the exhaust-gas turbocharger, a transmission of torque from the impeller to the exhaust-gas turbocharger shaft, and/or from the exhaust-gas turbocharger shaft to the impeller, is ensured.

For this purpose, it is already known for the compressor wheel of an exhaust-gas turbocharger to be connected to the exhaust-gas turbocharger shaft by a force-locking connection. For this purpose, the compressor wheel has a central bore which is placed in contact with the exhaust-gas turbocharger shaft by way of a suitable fit, wherein furthermore, a shaft nut is provided which is screwed onto the exhaust-gas turbocharger shaft and which prevents undesired axial displacements of the compressor wheel on the exhaust-gas turbocharger shaft. Such a force-locking connection connection however limits the upper limit of the torque that can be transmitted from the exhaust-gas turbocharger shaft to the compressor wheel, and thus also the diameter of the compressor wheel. This in turn limits the maximum air throughput through the compressor, and determines the construction kit size to be used for the compressor.

DE 10 2010 010 136 A1 has disclosed a shaft having at least one impeller, and a method for fastening an impeller to a shaft of the turbocharger. Said turbocharger shaft forms a form-locking connection with the impeller, wherein the impeller has at least one form-locking section which, in the assembled state, forms a form-locking connection in a radial direction and in a circumferential direction with an associated form-locking section of the shaft. Said form-locking sections of the impeller and of the shaft each have a knurling which has multiple grooves or serrations or teeth which engage into one another in order to generate the form-locking action. The known device furthermore has a shaft nut which is screwed onto the shaft end and which forms an axial force-locking connection and thus prevents undesired axial displacement of the impeller on the shaft.

BRIEF SUMMARY OF THE INVENTION

It is the object of the invention to improve an exhaust-gas turbocharger shaft which has an impeller connected in form-locking fashion thereto with regard to the form-locking connection.

Said object is achieved by means of an exhaust-gas turbocharger shaft having an impeller connected in form-locking fashion thereto. Said exhaust-gas turbocharger shaft is connected to a shaft nut provided on the outer shell thereof. Said shaft nut is inserted into a central bore of the impeller such that the impeller forms a form-locking connection in a radial direction and in a circumferential direction with the shaft nut provided on the outer shell of the exhaust-gas turbocharger shaft. The shaft nut is cohesively connected to the shaft. For example, the shaft nut is firstly screwed onto the shaft and then cohesively connected thereto. The cohesive connection may be realized for example by means of a welding process or an adhesive bonding process.

The central bore of the impeller advantageously has a receiving section whose internal shell shape corresponds to the external shell shape of the shaft nut. The shaft nut is inserted into said receiving section when the impeller has been fastened on the shaft. The shaft nut is preferably a hexagonal nut.

The advantages of the invention consist in particular in that the form-locking connection between the exhaust-gas turbocharger shaft and the impeller is reinforced through the use of the shaft nut as a form-locking element and the fixed connection of the shaft nut to the exhaust-gas turbocharger shaft. This is also contributed to by the robust form of the outer shell of the shaft nut, which increases the rotation prevention action between shaft nut and impeller and also reduces the likelihood of damage in the region of the contact points between the shaft nut and the impeller.

Said form-locking connection makes it possible for a high torque to be transmitted from the impeller to the shaft and vice versa. This permits inter alia the use of larger impellers in exhaust-gas turbochargers of unchanged size.

BRIEF DESCRIPTION OF THE SEVERAL VIEWS OF THE DRAWING

Further advantageous properties of the invention will emerge from the following exemplary explanation thereof on the basis of the figures, in which.

DESCRIPTION OF THE INVENTION

The invention relates to an exhaust-gas turbocharger shaft which has an impeller connected in form-locking fashion thereto and which is connected to a shaft nut provided on the outer shell thereof, wherein the shaft nut is inserted into a central bore of the impeller such that the impeller forms a form-locking connection in a radial direction and in a circumferential direction with the shaft nut.

The description below is based on the impeller being the compressor wheel of an exhaust-gas turbocharger. The invention may however also be used in the case of the impeller being the turbine wheel of an exhaust-gas turbocharger.

In the invention, a shaft nut is attached to the outer shell of an exhaust-gas turbocharger shaft. This is realized for example by virtue of the shaft nut, which is a hexagonal nut, being equipped on its internal shell with a thread, the exhaust-gas turbocharger shaft having an external thread on its outer shell, the hexagonal nut being screwed onto the exhaust-gas turbocharger shaft, and subsequently the shaft nut that has been screwed onto the exhaust-gas turbocharger shaft being cohesively connected to the exhaust-gas turbocharger shaft. It is alternatively also possible for the shaft nut to be of smooth form on its internal shell, for the external shell of the exhaust-gas turbocharger shaft to likewise be of smooth form, and for the shaft nut to be pushed onto the exhaust-gas turbocharger shaft and then cohesively connected thereto, for example by virtue of the shaft nut being welded to the exhaust-gas turbocharger shaft.

An exhaust-gas turbocharger shaft of said type which is connected to a shaft nut provided on its outer shell is inserted into a specially shaped central bore of the impeller such that the impeller forms a form-locking connection in the radial direction and in the circumferential direction with the shaft nut.

Figure 1:
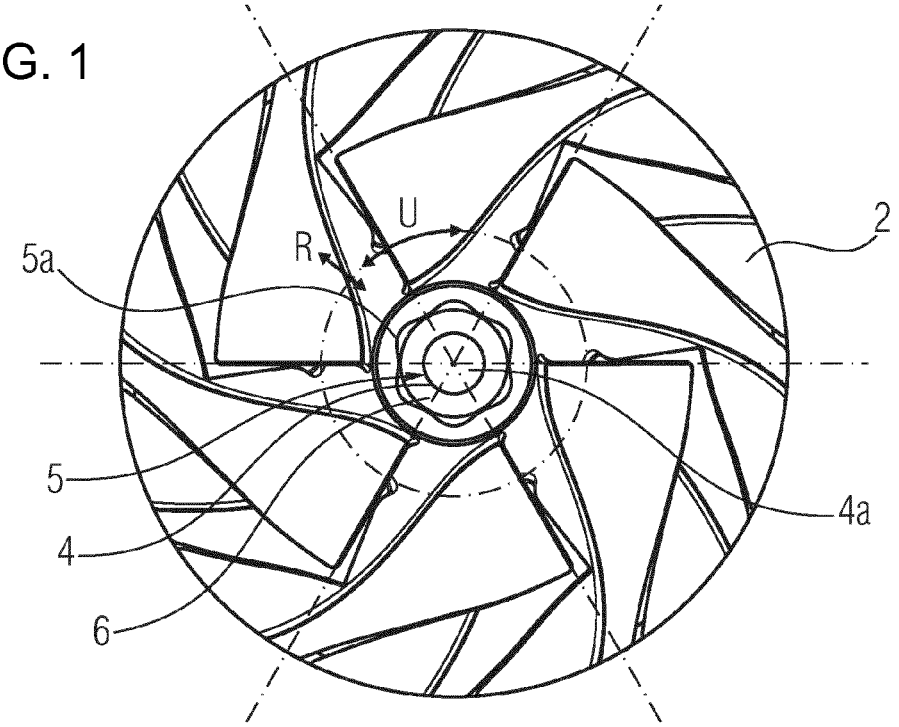
FIG. 1 shows a front view of an impeller of an exhaust-gas turbocharger for illustrating the embodiment of the central bore, provided for receiving the shaft nut and the shaft, of the impeller.

FIG. 1 shows the front view of an impeller 2 of an exhaust-gas turbocharger for illustrating the embodiment of the central bore 4, provided for receiving the shaft nut and the exhaust-gas turbocharger shaft, of the impeller 2. Said central bore 4 has a central region 4*a* extending all the way through, which central region is provided for the insertion of the exhaust-gas turbocharger shaft, and a receiving section 5, which is provided for the insertion of the shaft nut connected to the exhaust-gas turbocharger shaft. Said receiving section 5 has, at its rear axial end, an axial abutment surface 6 for the shaft nut. Said axial abutment surface 6 is formed by an encircling step of the central bore of the impeller.

The shape of the internal shell 5*a* of the receiving section 5 corresponds to the external shell shape of a hexagonal bolt, such that the hexagonal nut that has been fastened on the exhaust-gas turbocharger shaft can be inserted in an axial direction into the receiving section 5, such that in the inserted state, said hexagonal nut bears against the axial abutment surface 6 and forms a form-locking connection in the radial direction R and circumferential direction U with the impeller.

The receiving section 5 may be formed into the impeller 2 by way of a known deformation process, a known cutting process or a known primary forming process.

Figure 2:
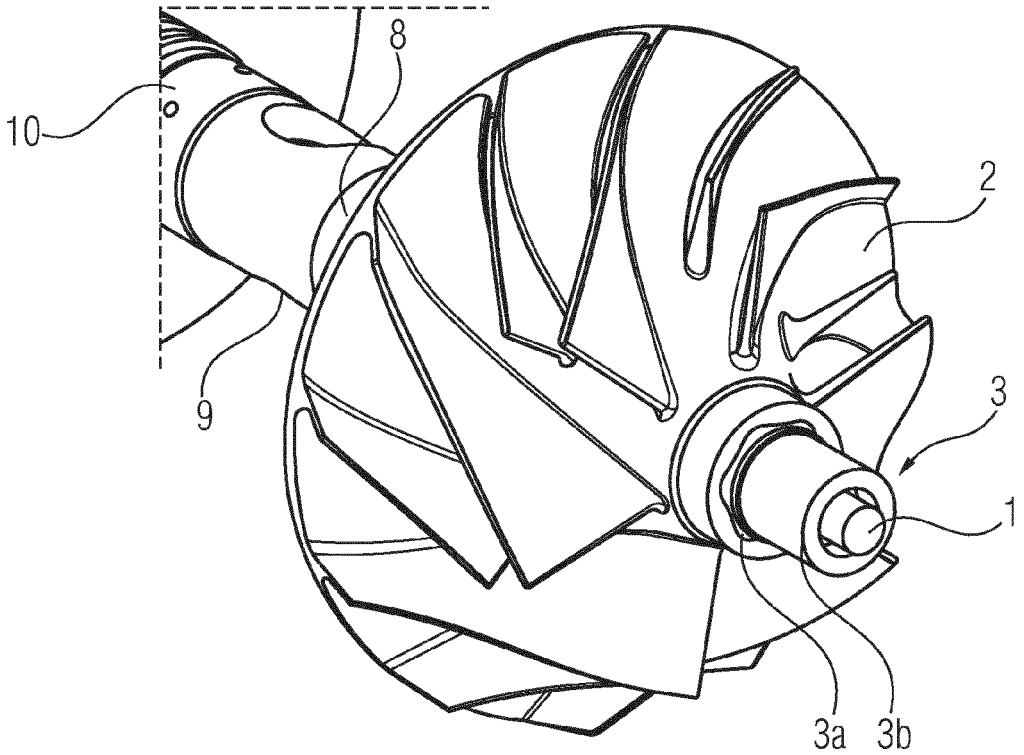
FIG. 2 shows a perspective view of an impeller with a shaft inserted into the central bore of the impeller.
Figure 4:
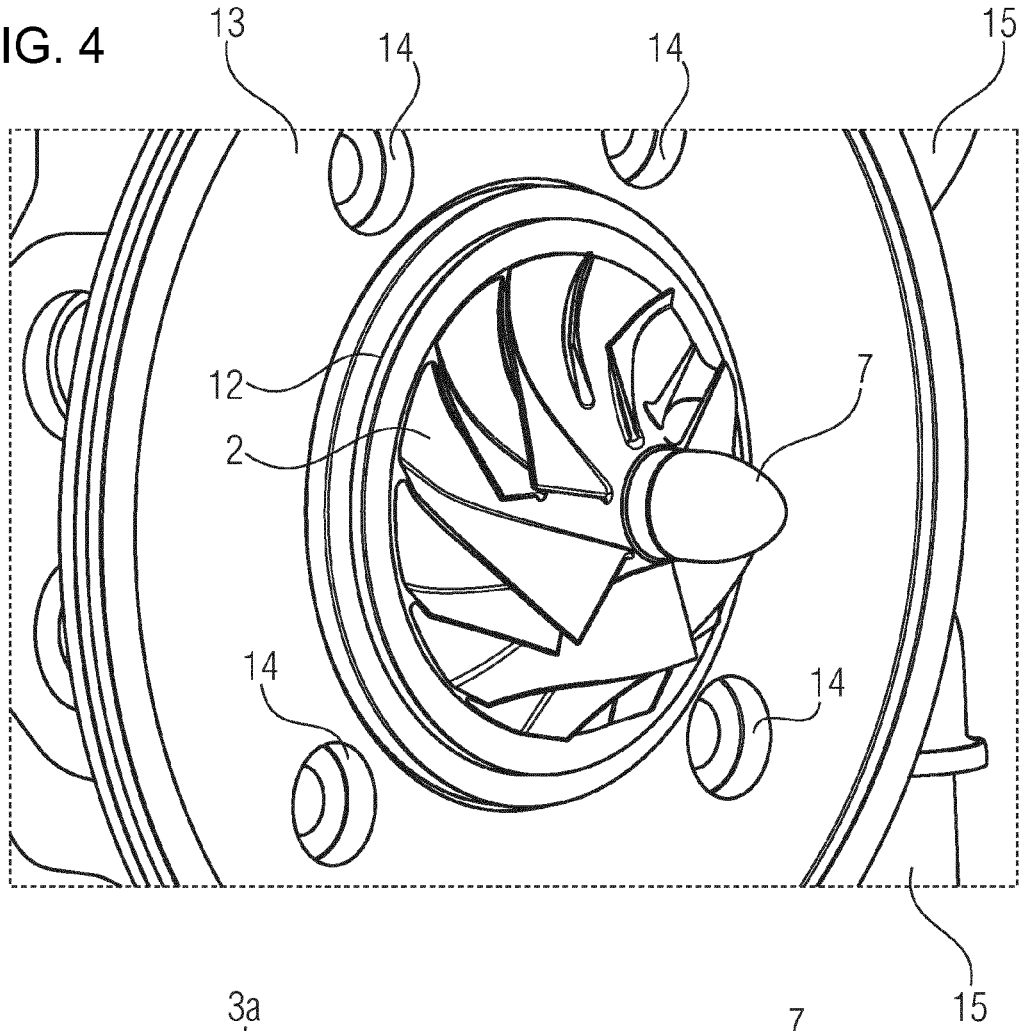
FIG. 4 is a longitudinal sectional illustration of an exhaust-gas turbocharger shaft with an impeller fastened thereto, with the shaft end region covered by a closure cap.
Figure 5:
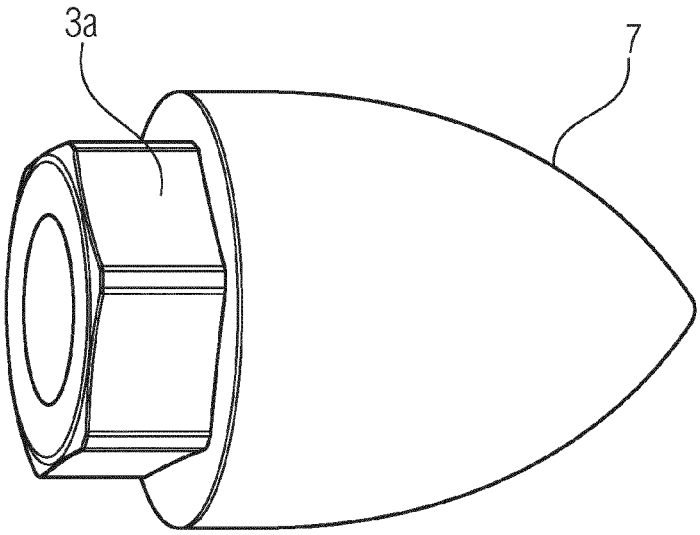
FIG. 5 is a sketch of a shaft nut connected to a closure cap.

FIG. 2 shows a perspective view of an impeller 2 with an exhaust-gas turbocharger shaft 1 inserted into the central bore of the impeller. In this exemplary embodiment, the shaft nut 3 has a first axial section 3*a* and a second axial section 3*b*. The first axial section 3*a* is fixedly connected to the exhaust-gas turbocharger shaft 1, is positioned in the receiving section 5 of the central bore of the impeller 2, has the shape of a hexagonal nut, and thus forms a form-locking connection in the radial direction and circumferential direction with the impeller. The second section 3*b* of the shaft nut 3 is arranged outside the receiving section 5 of the central bore of the impeller 2 in the axial direction. This has the advantage that, after the insertion of the exhaust-gas turbocharger shaft, with shaft nut fastened thereto, into the central bore of the impeller, a balancing process can be performed in order to optimize the smooth running of the exhaust-gas turbocharger shaft with impeller fastened thereto. Furthermore, this has the advantage that the forwardly protruding second axial section 3*b* of the shaft nut 3 can have a closure cap 7 mounted thereon, as shown in FIGS. 4 and 5.

It can also be seen from FIG. 2 that the exhaust-gas turbocharger shaft 1 is led through the impeller 2 and mounted, in the region behind the impeller 2, in a bearing bushing 10. It can also be seen from FIG. 2 that the shaft 1 is connected to a further impeller 11, which is the turbine wheel of the exhaust-gas turbocharger.

As an alternative to the example shown in FIG. 2, it may be provided that the shaft nut 3 has only the region 3*a* which has the shape of a hexagonal nut. In this case, it is possible for the shaft nut 3 to be of shortened design, to be inserted fully into the receiving section 5 of the impeller, and to have no further region projecting forwardly out of the receiving section 5 in the axial direction. Any necessary balancing of the exhaust-gas turbocharger shaft with impeller fastened thereto must in this case be performed at some other location, for example between the impeller blades on the compressor wheel hub.

Figure 3:
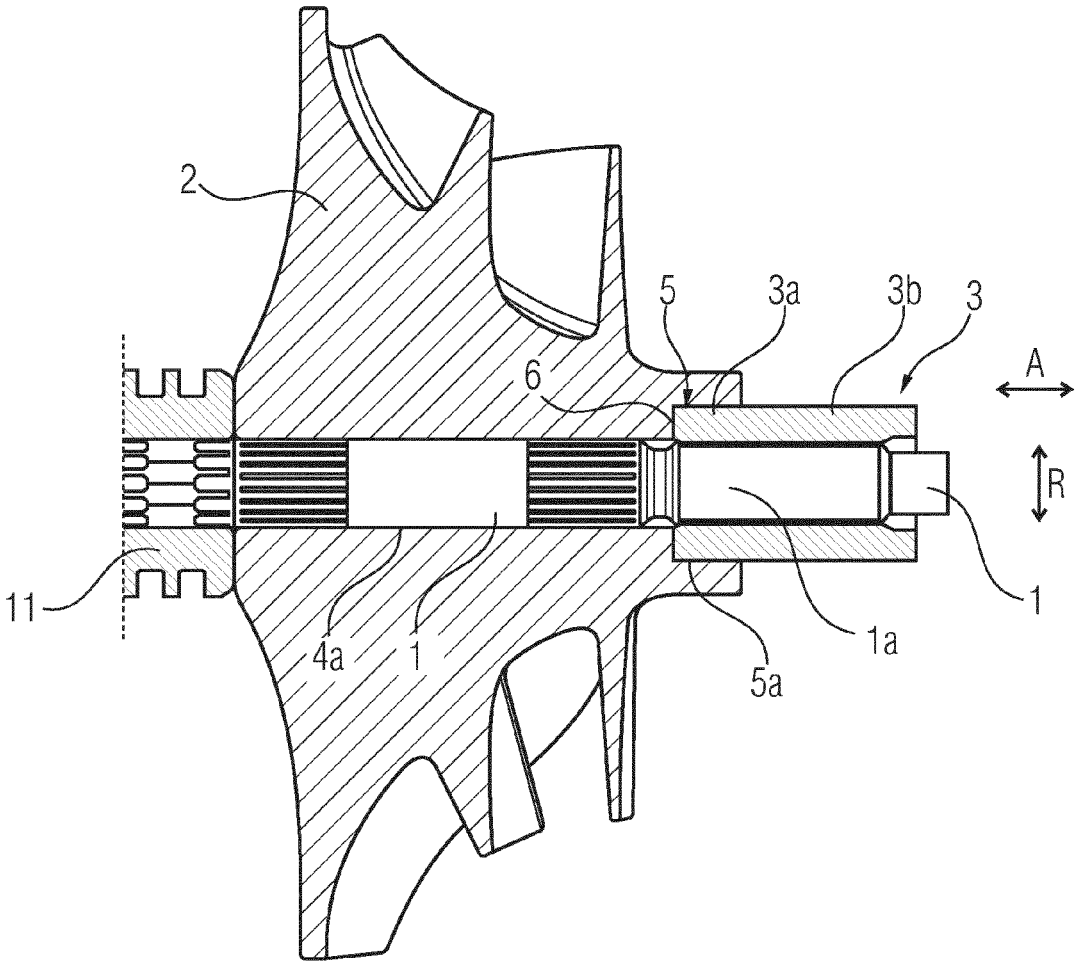
FIG. 3 is a longitudinal sectional illustration of an exhaust-gas turbocharger shaft with an impeller fastened thereto.

FIG. 3 is a longitudinal sectional illustration of an exhaust-gas turbocharger shaft 1 with an impeller 2 fastened thereto. As can be seen from this illustration, the exhaust-gas turbocharger shaft 1 is led through the central region 4*a*, which extends all the way through, of the central bore of the impeller 2, is led out of the impeller 2 at the rear end thereof, and there, is surrounded by a sealing bushing 8 and an oil diverting ring 9 and is mounted in a bearing bushing 10.

It can also be seen from FIG. 3 that the first axial section 3*a* of a shaft nut 3 is mounted in the receiving section 5 of the central bore of the impeller 2, wherein that end region of the first axial section 3*a* which is on the left in the figure bears against an axial abutment surface 6 which is formed by an encircling step of the central bore of the impeller 2 and which is adjacent to the receiving section 5 in the axial direction. The shape of the internal shell 5*a* of the receiving section 5 corresponds to the shape of the external shell of the first axial section 3*a* of the shaft nut 3 which is cohesively connected to the external shell 1*a* of the exhaust-gas turbocharger shaft 1, such that the impeller forms a form-locking connection in the radial direction R and in the circumferential direction with the shaft nut.

It can furthermore be seen from FIG. 3 that the shaft nut 3 has a second axial section 3*b* which is arranged outside the impeller 2, or outside the receiving section 5 thereof, in the axial direction A. As shown in FIG. 4, a closure cap 7 may be mounted on said second axial section 3*b*. This is preferably implemented in such a way that there is a stepless transition between the impeller and the closure cap.

FIG. 4 is a longitudinal sectional illustration of an exhaust-gas turbocharger shaft with a compressor wheel 2 fastened thereto. A shaft nut has been fastened on the exhaust-gas turbocharger shaft 1, which shaft nut forms a form-locking connection in the radial direction and circumferential direction with the compressor wheel 2. The axial end region of the exhaust-gas turbocharger shaft has been covered by a closure cap 7. Said closure cap 7 has been mounted onto the second axial section, which projects out of the compressor wheel in the axial direction, of the shaft nut such that there is a stepless transition between the closure cap 7 and the compressor wheel 2. This improves the smooth running of the rotating unit composed of the compressor wheel and the exhaust-gas turbocharger shaft.

It can furthermore be seen from FIG. 3 that a second impeller 11 is also provided on the exhaust-gas turbocharger shaft, which second impeller is the turbine wheel of the exhaust-gas turbocharger. It can also be seen from FIG. 4 that the exhaust-gas turbocharger shaft is led through the central region 4*a*, which extends all the way through, of the central bore of the compressor wheel, is led out of the compressor wheel 2 at the rear end thereof, and there, is surrounded by a sealing bushing 8 and an oil diverting ring 9 and is mounted in a bearing bushing 10.

FIG. 5 shows a sketch of a shaft nut which is connected to a closure cap 7. This exemplary embodiment concerns a shaft nut which has a first axial end region 3*a* and a second axial end region 3*b*. The latter is arranged within the closure cap 7 and is for example encapsulated thereby. The unit composed of shaft nut and closure cap 7 is for example screwed onto the exhaust-gas turbocharger shaft and cohesively connected thereto and then connected to the compressor wheel by being inserted into the central bore thereof, wherein the first axial region 3*a* of the shaft nut comes to lie in the receiving section 5 of the central bore of the compressor wheel, and after being inserted, is connected in form-locking fashion in the radial direction and circumferential direction to the compressor wheel.

The closure cap 7 and the shaft nut may be composed of different materials or may be composed of one and the same material. They may be produced as a unipartite component or else may be assembled from two different components.

It is for example the case that the shaft nut is composed of a metal and the closure cap is composed of plastic, wherein, in the installed state, the shaft nut has a section which is arranged outside the central bore of the impeller and which is encapsulated by the closure cap.

By means of the above-described arrangement of the shaft nut in the internal region of the impeller and the form-locking connection in the radial and circumferential directions between the shaft nut, which is fastened to the exhaust-gas turbocharger shaft, and the impeller, the torsional strength of the rotating parts of an exhaust-gas turbocharger is improved. Furthermore, new design possibilities are opened up. The rotating parts can for example be optimized in terms of flow and designed so as not to have an offset with respect to the impeller.

The invention claimed is:

1. An exhaust-gas turbocharger shaft assembly comprising:

an exhaust-gas turbocharger shaft having an outer shell formed with an external thread;

an impeller formed with a central bore, said impeller connected to said exhaust gas turbocharger shaft; and a shaft nut having with an inner shell formed with a thread and being disposed on said outer shell of said turbocharger shaft;

said shaft nut connected to said exhaust-gas turbocharger shaft by being screwed onto said exhaust-gas turbocharger shaft;

shaft nut having an external shell shape, and said central bore of said impeller having a receiving section with an internal shell shape corresponding to said external shape of said shaft nut;

said shaft nut inserted into said central bore of said impeller and forming a form-locking connection in a radial direction and in a circumferential direction with said impeller, said shaft nut having an axial direction and two sections extending along said axial direction, a first one of said two sections inserted into said central bore of said impeller, and second one of said two sections disposed outside said central bore of said impeller in said axial direction;

said second one of said two sections of said shaft nut having a cylindrical outer shell; and said first one of said two sections of said shaft nut being inserted into said central bore of said impeller and having a hexagonal external shell shape.

2. The exhaust-gas turbocharger shaft assembly according to claim 1, wherein said exhaust-gas turbocharger shaft is cohesively connected to said shaft nut provided on said outer shell.

3. The exhaust-gas turbocharger shaft assembly according to claim 1, wherein said central bore of said impeller has an internal shell with an axial abutment surface disposed adjacent said receiving section and abutting said shaft nut.

4. The exhaust-gas turbocharger shaft assembly according to claim 3, wherein said axial abutment surface is an encircling step on said internal shell of said central bore of said impeller.

5. The exhaust-gas turbocharger shaft assembly according to claim 1, which further comprises a closure cap covering said other section of said shaft nut disposed outside said central bore of said impeller.

6. The exhaust-gas turbocharger shaft assembly according to claim 5, wherein said closure cap is made of a material and said shaft nut is made of a material that is different from the material of said closure cap.

7. The exhaust-gas turbocharger shaft assembly according to claim 6, wherein said shaft nut is made of metal, said closure cap is made of plastic, and said second section of said shaft nut, which is disposed outside said central bore of said impeller, is encapsulated by said closure cap.

8. The exhaust-gas turbocharger shaft assembly according to claim 5, wherein said closure cap is made of a material and said shaft nut is also made of the material.

9. The exhaust-gas turbocharge shaft assembly according to claim 5, wherein said closure cap is formed without an offset relative to said impeller.

* * * * *